United States Patent [19]

Reinhardt

[11] Patent Number: 4,647,135

[45] Date of Patent: Mar. 3, 1987

[54] PLUG FOR AUDIO DEVICE

[75] Inventor: Chrys J. Reinhardt, Webster, N.Y.

[73] Assignee: Whirlwind Music Distributors, Inc., Rochester, N.Y.

[21] Appl. No.: 753,723

[22] Filed: Jul. 10, 1985

[51] Int. Cl.[4] ..... H01R 17/18

[52] U.S. Cl. ..... 339/103 R; 339/183

[58] Field of Search ..... 339/103 B, 103 C, 183, 339/103 R

[56] References Cited

U.S. PATENT DOCUMENTS

| | | | |
|---|---|---|---|
| 1,673,644 | 6/1928 | Shoe | 339/183 |
| 2,076,072 | 4/1937 | Douglas | 339/103 R |
| 2,716,740 | 8/1955 | Parish | 339/103 R |
| 3,678,440 | 7/1972 | Gilsdorf | 339/183 |
| 3,792,415 | 2/1974 | Fuller | 339/101 |
| 4,114,974 | 9/1978 | Lawrence | 339/103 C |
| 4,145,566 | 3/1979 | Weingartner | 339/103 R |
| 4,390,227 | 6/1983 | Deutsch | 339/103 C |

FOREIGN PATENT DOCUMENTS

| | | | |
|---|---|---|---|
| 3315863 | 12/1983 | Fed. Rep. of Germany | 339/103 B |
| 876293 | 8/1961 | United Kingdom | 339/103 R |

*Primary Examiner*—Gil Weidenfeld
*Assistant Examiner*—Gary F. Paumen
*Attorney, Agent, or Firm*—Shlesinger, Fitzsimmons & Shlesinger

[57] ABSTRACT

A generally tubular plastic collet, which is mounted coaxially in the bore of a rigid, tubular housing, has on one end thereof a plurality of radially flexible jaws that surround one end of an electrical cord that extends into the housing bore at one end thereof. A metal tip has an externally threaded shank that is adjustably threaded into the opposite end of the housing bore, and an elongate stem portion which projects to the exterior of the housing. The tip comprises a pair of coaxially disposed conductors insulated from each other in a conventional manner, and connected in the housing to a pair of wire conductors that project from the cord. The threaded end of the tip engages and urges the collet axially toward the inlet end of the housing, thereby flexing the collet jaws radially inwardly into gripping engagement with the cord.

4 Claims, 3 Drawing Figures

PLUG FOR AUDIO DEVICE

BACKGROUND OF THE INVENTION

This invention relates to plugs which are used for connecting wire leads to audio signal devices and the like. More particularly, this invention relates to an improved male plug containing a collet for quickly securing a wire lead in the plug.

Plugs of the type to which this invention is particularly directed, usually comprise a cylindrical stem or insert section having a conically shaped tip, which in use is removably inserted into a cylindrically shaped receptacle of the type frequently found in phonograph housing, amplifier housings, electric guitars, and the like. Plugs of this type are also commonly referred to as phone jacks or phono jacks.

This invention relates particularly to an improvement over a plur or jack of the type disclosed in U.S. Pat. No. 4,145,566, wherein a collet sleeve is positioned in the plug housing at the cord inlet end thereof, which is the end opposite to that from which the stem or insert section projects. One major problem with this type of jack is that the associated collet must be provided with internal or external threads, so that after one end of an electrical cord has been inserted into the collet, the latter can be drawn axially rearwardly in the plug housing toward its inlet end in order to cause the collet pressure elements to be urged radially inwardly into gripping engagement with the associated cord. This construction also requires a separte bushing to be threaded over the inlet end of the housing in order to grasp and draw the threaded collet axially with respect to the housing.

In addition to being rather expensive to manufacture this known type of plug also has the disadvantage that the threaded portions of the collet tend to fail after repreated use. Also, once the threads are stripped, the plug is no longer of any use.

It is an object of this invention, therefore, to provide an improved plug of the type described which includes a collet that can be made without the use of any internal or external threads thereon. Moreover, the collet employed in this invention is not subjected to any axial tensile forces in order to effect closure of its cord gripping jaws.

Still another object of this invention is to provide an improved plug of the type described in which the collet is shifted axially within the plug housing under compressive stresses, rather than tensile stresses. It is an object also, therefore, to construct the plug in such manner that the collet is urged axially into an active position by the male end of the plug, which is releasably threaded into the plug housing compressibly to engage and urge one end of the collet axially into an operative position in the housing.

Other objects of the invention will be apparent hereinafter from the specification and from the recital of the appended claims, particularly when read in conjunction with the accompanying drawing.

SUMMARY OF THE INVENTION

The plug housing has therethrough an axial bore which is internally threaded at one end, and has an internal, circumferential shoulder adjacent its opposite, cord-inlet end. A plastic collet is positioned in the bore of the housing and has thereon a plurality of radially compressible jaws facing the internal shoulder. One end of an electrical cord is inserted into the collet jaws through the inlet end of the housing, and its wire leads are connected to a pair of terminals which project from an externally threaded shoulder formed on one end of the stem or insert section of the plug. This shoulder is then threaded into the housing and engages and forces the collet toward the internal shoulder at the inlet end of the housing thus forcing the jaws into gripping engagement with the cord.

THE DRAWING

DETAILED DESCRIPTION OF THE PREFERRED EMBODIMENTS

Figure 1:
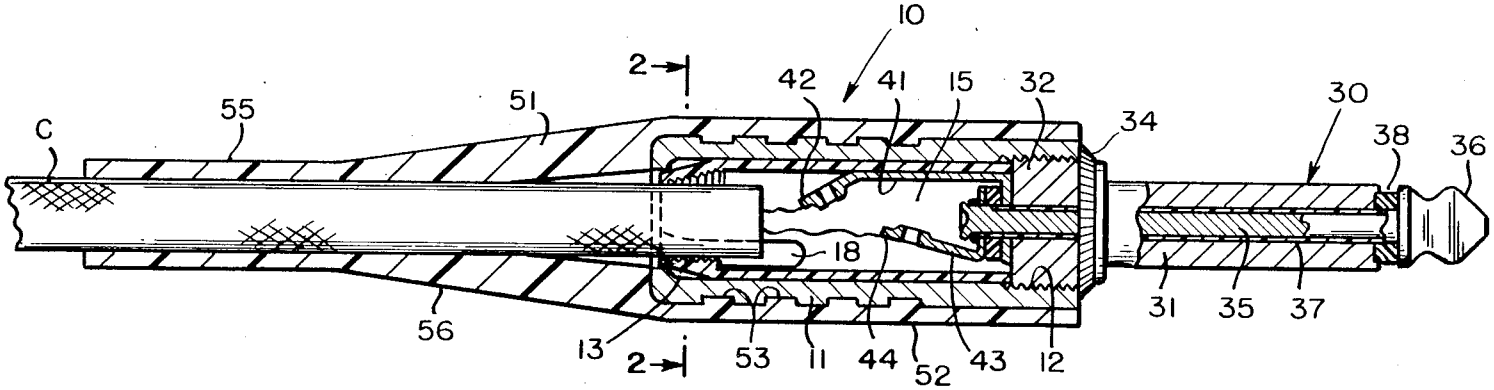
FIG. 1 is a longitudinal sectionalview taken diametrally through the center of an improved plug made according to one embodiment of this invention, portions of the plug being shown in full, and one end of an associated electric cord being shown as it appears when it is secured within the plug.
Figure 3:
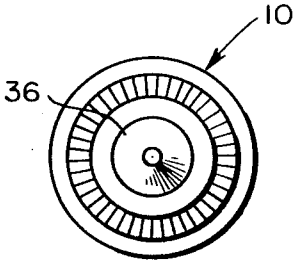
FIG. 3 is an end view of this plug as seen when viewing the plug from the right end of FIG. 1.
Figure 2:
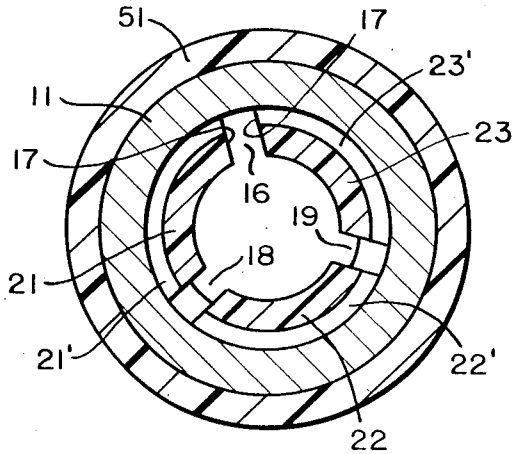
FIG. 2 is an enlarged sectional view taken generally along the line 2—2 in FIG. 1 looking in the direction of the arrows.

Referring now to the drawing by numerals of reference, 10 denotes generally an improved phone plug or the like, comprising a metal sleeve housing 11 having therethrough an axial bore part of which at one end of the sleeve is internally threaded as at 12. At its opposite or cable inlet end (the left end in FIG. 1) the wall of the bore in sleeve 11 has formed thereon an internal conical or tapered surface 13, which terminates at the inlet end of the sleeve. Because of this tapered surface, the inlet end of sleeve 11 has an internal diameter less than that portion of the bore in sleeve 11 lying between its internally threaded section 12 and its conically shaped section 13.

Secured coaxially in the bore of sleeve 11 is a nearly tubular shaped collet 15 the outer peripheral surface of which, as shown in FIG. 1, is engaged for a major portion of its length with the internal peripheral surface of sleeve 11. The collet 15 has at one side thereof an elongate slot 16, opposite sides of which are bound by two, confronting, longitudinally extending edges 17 of the collet. As noted hereinafter, this slot or space 16 between the collet edges 17 enables the overall outside diameter of the collet to be adjusted slightly (for example to retract), when the collet is inserted in sleeve 11.

At one end thereof (the left end in FIG. 1) collet 15 has formed therein two additional, axially extending slots 18 and 19, which are equi-angularly spaced about the axis of the collet from each other and from the slot 16. Unlike slot 16, however, slots 18, 19 extend only part way axially into the collet 15. The three slots 16, 18 and 19 operatively divide one end of the collet (the left or inlet end as shown in FIG. 1) into three, spaced, flexible jaws 21, 22 and 23. Moreover each of the jaws has formed thereon adjacent its terminal or left end as shown in FIG. 1 a tapered or frusto-conically shaped surface 21', 22' and 23', respectively, which confronts upon the internal conical surface 13 located at the inlet end of sleeve 11.

Collet 15 is releasably secured in the sleeve 11 by a brass tip, which is denoted generally at 30 in the drawing. Tip 30 comprises an elongate, cylindrically shaped stem or insert portion 31, which projects coaxially beyond housing 11 at the end thereof remote from its inlet end. Tip 30 has thereon an enlarged-diameter, externally threaded shank portion 32, which is releasably threaded into the threaded section 12 of the bore in sleeve 11 so that the inner, terminal end of shank 32 engages the collet 15 at its end remote from its jaws 21, 22 and 23. Intermediate its ends the tip 30 has formed thereon an external, circumferential shoulder 34, which overlies the right end of sleeve 11 to limit the extent to which the tip 30 can be threaded into the sleeve 11.

Secured in an axial bore which extends coaxially through the stem and shank portion 31, 32 of the tip 30 is a metal rod or conductor 35. Conductor 35 extends at its inner end into the bore in the collet 15 coaxially thereof, and projects at its opposite end coaxially beyond the outer end of stem 31 and has formed thereon a conventional, conically shaped head 36. Counductor 35 and its head 36 are completely insulated from the stem and shank portions 31, 32 of the tip 30 by means of a plastic or dielectric sleeve 37, which surrounds the conductor 35, and by a plastic ring or washer 38, which is interposed between head 36 of the conductor and the outer end of stem 31.

Fastened at one end to the inner end of the shank 32 of tip 30 is a first terminal plate 41, the opposite end of which is adapted to be soldered or otherwise connected as at 42 to one of the two conductors or wires that form part of a cable or electrical cord C, which is adapted to be secured at one end in the plug 10 as noted hereinafter. It will be noted that plate 41 is insulated from the conductor 35 by virtue of the insulating sleeve 37.

Secured electrically at one end to the inner end of plug 35 within the bore of collet 15 is a second terminal plate 43, which is secured, for example by soldering, at its opposite end as at 44 to the other conductor in cord C. In this manner one of the conductors in cord C is electrically connected to the stem 31, while the other conductor is electrically connected to the conductor 35 and its head 36. It should be noted that, apart from the manner in which it is connected to sleeve 11 and is associated with the collet 15, the tip 30 is otherwise well known in the art.

The housing 11, and the portion of the cable C adjacent the housing inlet end, are enclosed within a non-rigid plastic boot or sleeve 51. The portion 52 of boot 51 which surrounds the sleeve or housing 11 has a cylindrically shaped outer peripheral surface and an inner peripheral surface which has formed thereon a plurality of axially spaced, circumferential internal shoulders or lands 53, which seat in correspondingly shaped grooves or recesses formed in the outer peripheral surface of sleeve 11, thereby helping to secure the boot to sleeve 11. At its end remote from sleeve 11 the boot 51 has formed thereon a reduced-diameter, cylindrically shaped portion 55, which is connected to portion 52 of the boot by a tapered or frusto conically shaped portion 56. In practice, the boot 51 may be made from a heat-shrinkable plastic material, such as for example as from a polyvinyl chloride or polyurethane plastic material.

Before the parts are assembled as shown in FIG. 1, and before the shank 32 of the tip is threaded into the sleeve 11, the terminal end of the cord C can be inserted slidably through the bore in boot 51, then through the inlet end of sleeve 11 and out of the opposite end thereof. The two wire conductors in the cord C can then be soldered or otherwise secured as at 42 and at 44 to the two terminal plates 41 and 43 on tip 30. The slotted collet 15 can then be inserted over these connections by separating or spreading its opposed slot edges 17 until the collet is inserted over the terminal end of the cable C and the now-soldered ends of the cable conductors. The cable and the surrounding collet 15 can then be drawn axially rearwardly into the bore in the sleeve 11, at which time the shank 32 of the tip 30 can then be threaded into portion 12 of the bore in sleeve 11 in order to engage and urge the collet 15 axially in the bore of housing 11 toward its inlet end. This causes the tapered surfaces 21', 22' and 23' of jaws 21–23 slidably to engage the housing shoulder 13, whereby the collet jaws are urged radially inwardly into gripping engagement with cord C. The boot 51 can then be slid into proper positon over housing 11 and can be heated until it shrinks into gripping engagement with the housing and cord as shown in FIG. 1.

From the foregoing it will be apparent that the present invention provides a relatively simple and inexpensive means for quickly and securely fastening one end of an electrical cord to a phone jack or plug. Unlike prior plugs of the type noted above, the collet employed with this novel plug does not require the formation thereon of any threads, and the plug itself consists of fewer parts than heretofore utilized in collet chucking plugs. Rather than utilizing axial tensile forces for operating the collet jaws, the plug herein relies simply upon compressive stresses created by insertion of the tip into the plug housing. Moreover, the shoulder 34 on the tip limits the extent to which the tip 30 can be threaded into housing 11, and thus prevents any accidental damage to collet 15.

While this invention has been illustrated and described in connection with only one embodiment thereof, it will be apparent that this application is intended to cover any modifications thereof which might fall within the scope of one skilled in the art, or the appended claims.

I claim:

1. An improved electrical plug, comprising a rigid housing having therethrough an axial bore having a reduced-diameter inlet opening at one end thereof for slidably receiving one end of an insulated electrical cord containing two wire conductors, a metal tip removably mounted at one end into and closing the opposite end of said housing, said tip comprising a pair of coaxial conductors secured one to the other and extending into said housing for connection to said two air conductors, and projecting coaxially beyond and out of said opposite end of said housing, and a generally tubular-shaped one-piece collet mounted in the bore of said housing to extend between said inlet opening and said one end of said tip, said collet having formed on one end thereof a plurality of radially flexible jaws confronting on said inlet opening and disposed to surround said one of said cord when the latter is inserted into said inlet opening, and said one end of said tip comprising an externally threaded portion of one of said coaxial conductors threaded in said opposite end of said housing for limited axial adjustment into an operative position in which said one end of said tip engages and causes said collet to be urged axially against said inlet opening, thereby to cause said jaws to be flexed radially inwardly by the marginal edge of said inlet opening, and into gripping engagement with said one end of said cord.

2. An improved electrical plug as defined in claim 1, wherein said housing has in its outer peripheral surface a plurality of axially spaced, circumferential recesses.

3. An improved electrical plug as defined in claim 1, wherein said collet is made from a flexible, plastic material.

4. An improved electrical plug as defined in claim 1, wherein said one coaxial conductor has intermediate its ends an external circumferential shoulder engagable with said opposite end of said housing to limit the extent to which said one end of the tip can be threaded into said housing.

* * * * *